US009808657B2

(12) United States Patent
Rosert et al.

(10) Patent No.: US 9,808,657 B2
(45) Date of Patent: Nov. 7, 2017

(54) DIRECTIONAL VALVE AND BREATHING MASK WITH A DIRECTIONAL VALVE

(75) Inventors: Michael Rosert, Timmendorfer Strand (DE); Dennis Leske, Eutin (DE); Harald Heyer, Klein Wesenberg (DE); Thomas Pancur, Altenholz (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 865 days.

(21) Appl. No.: 13/467,516

(22) Filed: May 9, 2012

(65) Prior Publication Data

US 2013/0068232 A1 Mar. 21, 2013

(30) Foreign Application Priority Data

Sep. 17, 2011 (DE) ..... 10 2011 113 716

(51) Int. Cl.
*A62B 18/00* (2006.01)
*A62B 18/10* (2006.01)

(52) U.S. Cl.
CPC ..... *A62B 18/10* (2013.01)

(58) Field of Classification Search
CPC A61M 16/00; A61M 16/0468–16/047; A61M 16/06; A61M 16/20; A61M 16/208; A61M 16/209; A61B 9/00; A61B 9/02–9/027; A62B 18/00; A62B 18/06; A62B 18/08; A62B 18/084; A62B 18/025; A62B 18/10; A62B 23/00; A62B 23/02; A62B 23/025
See application file for complete search history.

(56) References Cited

U.S. PATENT DOCUMENTS

| | | | | | |
|---|---|---|---|---|---|
| 2,225,395 | A | * | 12/1940 | Young | F16K 15/148 137/512.15 |
| 3,602,219 | A | * | 8/1971 | Warncke | 128/201.15 |
| 3,990,439 | A | * | 11/1976 | Klinger | 128/207.12 |
| 5,154,168 | A | | 10/1992 | Schlobohm | |
| 6,047,698 | A | * | 4/2000 | Magidson | A62B 18/10 128/205.24 |
| 7,252,110 | B2 | | 8/2007 | Semeia | |
| 2004/0261795 | A1 | | 12/2004 | Brunell | |

FOREIGN PATENT DOCUMENTS

| | | | |
|---|---|---|---|
| DE | 40 17336 | C1 | 6/1991 |
| EP | 1445521 | A1 | 8/2004 |
| WO | 2008092052 | A2 | 7/2008 |

* cited by examiner

*Primary Examiner* — Todd J Scherbel
*Assistant Examiner* — Ned T Heffner
(74) *Attorney, Agent, or Firm* — McGlew and Tuttle, P.C.

(57) ABSTRACT

A directional valve includes a fixing lug (13), which is arranged eccentrically to a valve membrane (16) and is arranged at a valve housing (15). The dimensions of the fixing lug (13) are selected for fixing the valve membrane (16) relative to the sealing surface (2) of valve seat (1). The size of the eccentric offset (x) is in a range between 8% and 15% of the axis length (D) of the greatest longitudinal extension of valve membrane (16).

17 Claims, 4 Drawing Sheets

DIRECTIONAL VALVE AND BREATHING MASK WITH A DIRECTIONAL VALVE

CROSS REFERENCE TO RELATED APPLICATIONS

This application claims the benefit of priority under 35 U.S.C. §119 of German Patent Application DE 10 2011 113 716.9 filed Sep. 17, 2011, the entire contents of which are incorporated herein by reference.

FIELD OF THE INVENTION

The present invention pertains to a directional valve and to a breathing mask with a directional valve.

BACKGROUND OF THE INVENTION

A breathing mask with port openings for filters as well as with an inspiration valve and with an expiration valve is known from DE 40 17 336 C1. Respirator filters can be arranged at various points of the half mask by means of a connection adapter, which can be fastened to a half mask in two preferential positions. The gas flow is sent to the mask user via the respirator filters into the mask interior by means of directional valves, which are arranged both in the area of the respirator filters and at the gas outlet of the breathing mask, and the breathing gas enters the environment via an expiration valve during the expiration phase. The directional valves comprise a valve seat and a valve membrane, which lies on the valve seat and is fastened centrally to the valve seat. The valve membrane is lifted off from the valve seat during gas flow, so that a gas flow is made possible. The drawback of the prior-art valve construction is that the flow resistance is relatively high. The length of the membrane section that can be deflected by the gas flow is limited by the diameter of the valve seat due to the central fastening of the valve membrane.

Directional valves for breathing masks are known, which have a valve membrane fastened to the valve seat on one side and can be lifted off from the valve seat in a flap-like manner. Such a directional valve appears, for example, from U.S. Pat. No. 6,047,698. A valve membrane cut to a rectangular shape lies on a flat valve seat and is pressed by a fixing lug fastened to the edge of the valve bonnet against the valve seat. Even though a markedly lower flow resistance can be obtained with this valve construction compared to a directional valve with centrally fastened valve membrane, the leakage values are nevertheless higher because the valve membrane is fastened on one side, and the valve membrane may remain stuck to the inside of the valve bonnet due to adhesive forces in case of a possible condensation of moist expired air, as a result of which the closing operation of the directional valve may be delayed or the closing operation may fail to occur altogether.

SUMMARY OF THE INVENTION

A basic object of the present invention is to improve a directional valve in respect to its functional properties and to propose a breathing mask with a corresponding directional valve. In particular, a high level of tightness of the valve shall also be ensured if the expired air has a high moisture content or the breathing mask is being used in a moist environment.

It was found that the flow resistance decreases markedly in case of a slightly eccentric fixation of the valve membrane in an area between 8% and 15% of the axis length D of the greatest longitudinal extension of the valve membrane. The flow resistance is only about 60% of the value for a centrally fastened valve membrane at gas flows of up to about 80 L/minute in the case of a round, eccentrically fixed valve membrane. The valve membrane is preferably circular, but it may also have an oval, elliptical, square or rectangular shape. The axis length is the diameter D of the valve membrane in case of a circularly shaped valve membrane. The axis length of the greatest longitudinal extension is defined as the length of the main axis for the case of an elliptical valve membrane. The valve membrane is fixed by a fixing lug at the valve seat. The fixing lug is arranged at the valve housing, preferably at a valve bonnet of the valve housing comprising a valve bonnet and valve seat. The dimensions of the fixing lug are selected to be such that the valve membrane is in contact with the sealing surface of the valve seat in the absence of flow through the valve and during an inspiration phase. The fixing lug is preferably Y-shaped and has a plurality of fixing points. A specific arching of the valve membrane can be achieved due to this shape, so that the valve membrane is in contact with the sealing surface with a prestress and secured sealing is guaranteed. In addition, the eccentric fastening of the valve membrane according to the present invention leads to the advantage that adhesive effects of the valve membrane on the valve bonnet as a consequence of condensed moisture do not occur, because the lift of the freely mobile surface of the valve membrane is markedly smaller in case of a slightly eccentric fixation than in case of fixation at the edge. Since the valve membrane can move freely on both sides of the fixing lug, which fixes the valve membrane to the valve seat, the entire opening located within the sealing surface is available for the flow of gas in one direction such as during an expiration phase. Both a mechanically stable fastening of the valve membrane in the vicinity of the center of the membrane and reduced flow resistance compared to the central fixation are achieved with the eccentric fixation of the valve membrane according to the present invention.

Breathing masks with the directional valve according to the present invention are half masks, full masks, filtering half masks, but it is also possible to equip protective hoods with the directional valve.

An exemplary embodiment of the device according to the present invention is shown in the drawings and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
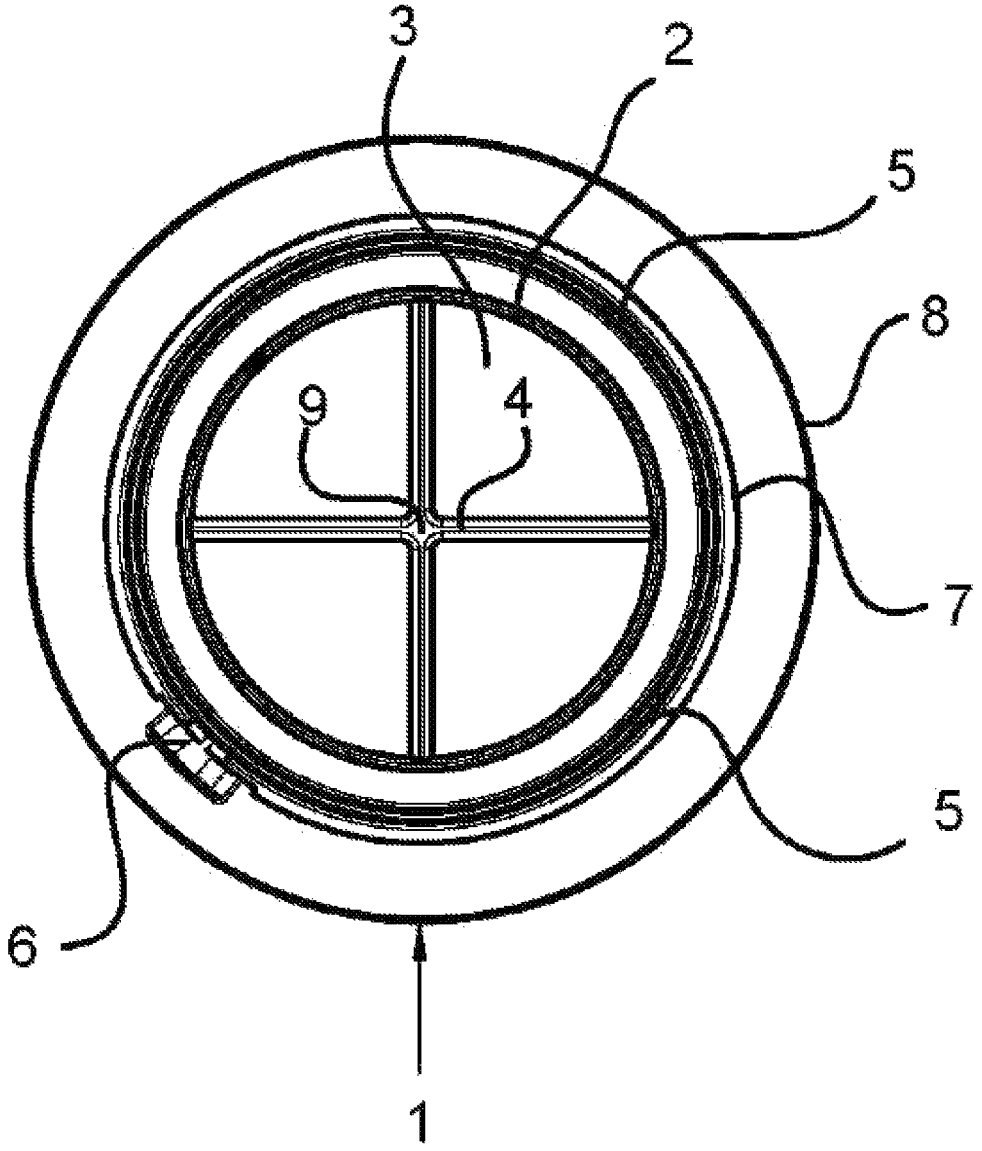
FIG. 1 is a view of a valve seat of a directional valve according to the invention.

Referring to the drawings in particular, FIG. 1 shows a valve seat with a flat sealing surface 2, which surrounds an opening 3 through which the gas flows. Opening 3 is divided by a valve cross 4 into four sectors. An upright edge 5, which receives a valve membrane, not shown in FIG. 1, and centers same against the sealing surface 2, is located around valve surface 2. A centering projection 6 and a circumferential bead 7 are located on the outside of edge 5. The underside 8 of valve seat 1 is connected to a filter mask, not shown in the figure. The webs of valve cross 4 intersect in a center 9.

Figure 2:
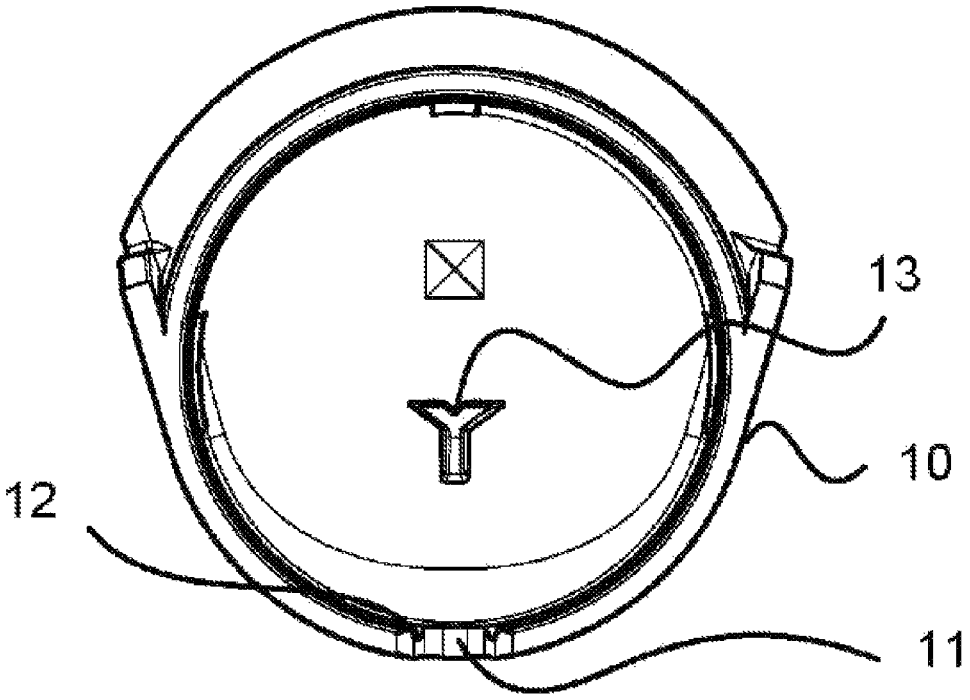
FIG. 2 is a view of a valve bonnet of the directional valve according to the invention.

FIG. 2 illustrates a valve bonnet 10, which is placed on the valve seat 1, FIG. 1, and has for this a centering groove 11, corresponding to centering projection 6, and a circumferential groove 12, corresponding to bead 7. On the inside, valve bonnet 10 has a fixing lug 13, which is directed towards the sealing surface 2.

Valve seat 1 and valve bonnet 10 together form a valve housing 15. The directional valve 20 is formed by the valve housing 15 with the valve membrane 16 inserted. The directional valve 20 is connected as an expiration valve on the underside 8 of valve seat 1 with a filter mask 22. Filter mask 22 and directional valve 20 together form a breathing mask, FIG. 3.

Figure 3:
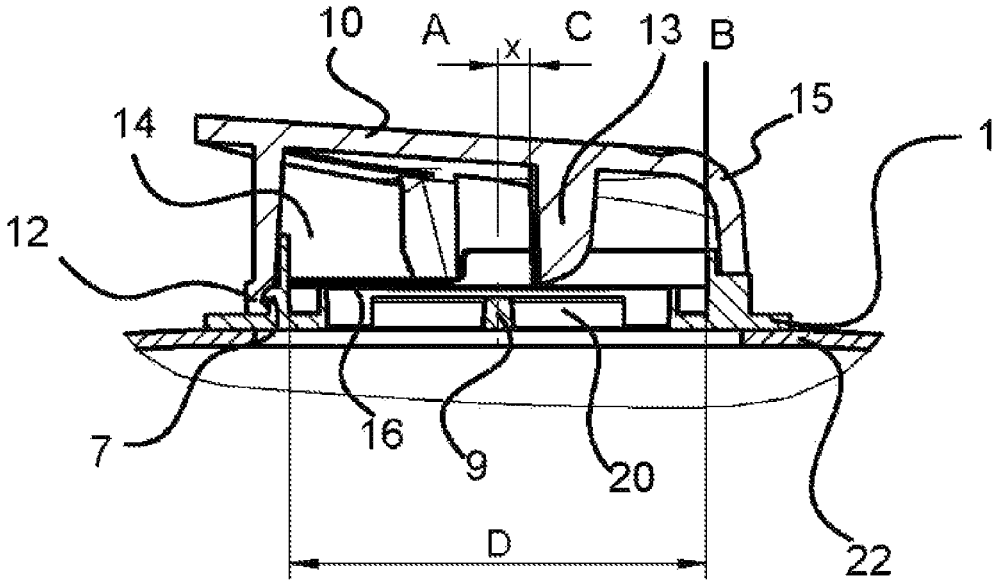
FIG. 3 is a longitudinal sectional view of the directional valve.

FIG. 3 shows the directional valve 20 in a longitudinal section and a detail of the breathing mask. Identical components are designated by the same reference numbers as in FIGS. 1 and 2. Fixing lug 13 is fastened to the inside of valve bonnet 10 such that an offset x is obtained relative to the center 9. Relative to the diameter D of valve membrane 16, the ratio x/D is in a range of 8% to 15%. The fact that fixing lug 13, and a corresponding fixed portion of valve membrane 16, is positioned in the vicinity of center 9 causes a movable portion of the valve membrane 16 to be lifted off from the sealing surface 2 on both sides of fixing lug 13 during the flow of gas in one direction. The valve membrane 16 on both sides of, or surrounding, the fixing lug 13 being a movable portion of the valve membrane 16. The fixed portion of the valve membrane 16 being that portion of the valve membrane 16 directly contacted by the fixing lug 13, especially as shown in FIGS. 2 and 3. The expired gas enters the environment via outflow openings 14 during the flow in the one direction.

Figure 4:
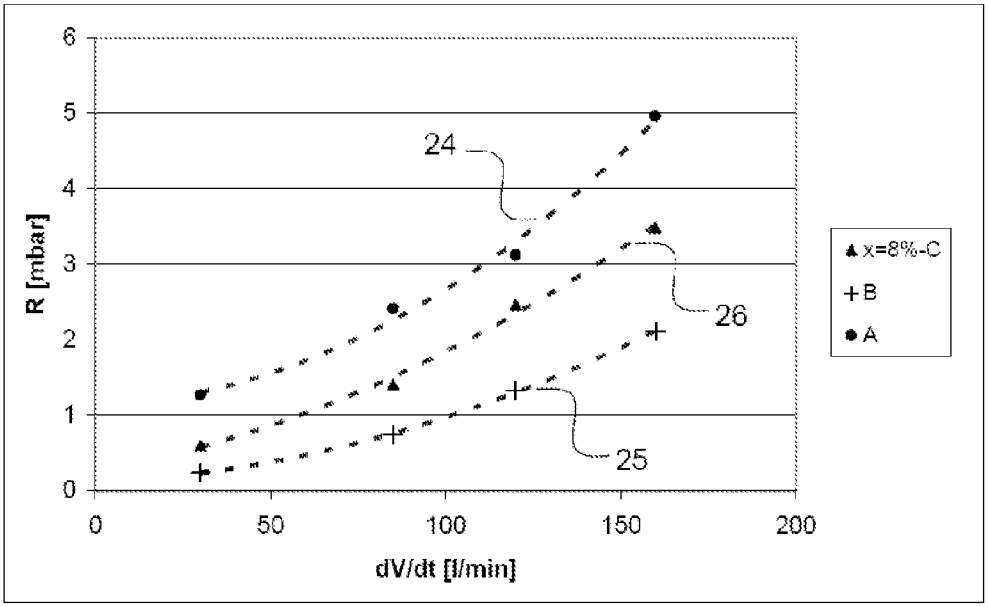
FIG. 4 is a graph showing measurement results for the flow resistance R as a function of the gas flow, dV/dt, through the directional valve.

FIG. 4 shows the flow resistance R as a function of the gas flow dV/dt through the directional valve 20. The abscissa shows the gas flow dV/dt in a range of up to 160 L/minute and the ordinate shows the flow resistance R as a static pressure in a range of up to 6 mbar. Curve 24 shows as the first limit value the flow resistance R for a fixing lug 13 positioned in center 9, position "A" in FIG. 3. FIG. 4 illustrates as a second limit value the flow resistance R for a position of the fixing lug at the edge of the sealing surface 2, position "B" in FIG. 3. The middle curve 26 shows the flow resistance R for the arrangement of fixing lug 13 according to the present invention, position "C" in FIG. 3. Even though fixing lug 13 is offset by only 8% in relation to center 9 relative to the diameter D, the flow resistance R increases by only 0.6 mbar at a gas flow of 80 L/minute compared to position "B" of the fixing lug, whereas the flow resistance more than doubles in case of a centrally positioned fixing lug, corresponding to position "A."

A slight displacement of fixing lug 13 from the center already leads to a marked reduction of flow resistance R.

While specific embodiments of the invention have been shown and described in detail to illustrate the application of the principles of the invention, it will be understood that the invention may be embodied otherwise without departing from such principles.

LIST OF REFERENCE NUMBERS

1 Valve seat
2 Sealing surface
3 Opening
4 Valve cross
5 Upright edge
6 Centering projection
7 Bead
8 Underside
9 Center
10 Valve bonnet
11 Centering groove
12 Circumferential groove
13 Fixing lug
14 Discharge openings
15 Valve housing
16 Valve membrane
20 Directional valve
22 Filter mask
24 Curve A
25 Curve B
26 Curve C

What is claimed is:

1. A directional valve for a breathing mask, the directional valve comprising:

a valve housing with a valve seat;

a flexible valve membrane with a circumference, which presets a total area, a circumferential area and a longitudinal axis, said valve seat receiving said flexible valve membrane, said valve seat having an annular essentially flat sealing surface, which surrounds an opening and is sealingly covered by at least partial areas of the circumferential area of said valve membrane during an inspiration phase; and a fixing lug arranged at said valve housing for eccentrically fixing said valve membrane in said valve seat with regard to an axis length of a greatest longitudinal extension of said valve membrane, said fixing lug supporting sealing of said sealing surface by said valve membrane during an inspiration phase, wherein said fixing lug is arranged between a center point of said total area of said valve membrane and an edge of said valve membrane such that an entire said circumferential area of said valve membrane lifts off from said sealing surface during an expiration phase, said fixing lug also being arranged to cause said center point of said total area of said valve membrane to move away from said valve seat during the expiration phase, whereby a flow resistance that is lower compared to a central arrangement of said fixing lug becomes established for an expired gas, said fixing lug being arranged on a side of said membrane diametrically opposite said valve seat, said fixing lug having a Y-shaped cross section.

2. A directional valve in accordance with claim 1, wherein:

said fixing lug is arranged offset relative to said center point of said total area in a range between 8% and 25% relative to a dimension of the longitudinal axis of said valve membrane.

3. A directional valve in accordance with claim 1, wherein said fixing lug has a plurality of fixing points, all of said fixing points being eccentrically arranged on said flexible valve membrane.

4. A directional valve in accordance with claim 1, wherein said valve membrane is circular and the longitudinal axis is the diameter of valve membrane.

5. A directional valve in accordance with claim 1, wherein:

said flexible valve membrane has a fixed portion arranged eccentrically relative to said valve membrane, all points in said eccentrically fixed portion being eccentrically arranged on said flexible valve membrane, said fixing lug fixing said fixed portion of said valve membrane relative to said valve seat;

said flexible valve membrane has a movable portion including all of said valve membrane between said circumference and said fixed portion, and also including all of said valve membrane not included in said eccentrically fixed portion;

said valve seat and said fixing lug are dimensioned to be able to move all of said movable portion of said valve membrane away from said valve seat during flow through said opening during the expiration phase.

6. A breathing mask with a directional valve comprising:

a valve housing with a valve seat;

a flexible valve membrane with a circumference, which presets a total area, a circumferential area, a fixed portion and a longitudinal axis, said valve seat receiving said flexible valve membrane, said valve seat having an annular essentially flat sealing surface, which surrounds an opening and is sealingly covered by at least partial areas of the circumferential area of said valve membrane during an inspiration phase; and a fixing lug arranged at said valve housing for fixing said valve membrane in said valve seat, said fixing lug being arranged on a side of said membrane diametrically opposite said valve seat, said fixing lug eccentrically fixing said fixed portion with regard to an axis length of a greatest longitudinal extension of said valve membrane relative to said valve seat, and for supporting sealing of said sealing surface by said valve membrane during inspiration, all points in said eccentrically fixed portion being eccentrically arranged on said flexible valve membrane, wherein said fixing lug and said fixed portion are arranged between a center point of said total area of said valve membrane and an edge of said valve membrane such that an entire said circumferential area of said valve membrane lifts off from said sealing surface during an expiration phase, and such that all of said valve membrane around said eccentrically fixed portion is able to move away from said valve seat during the expiration phase, a position of said fixed lug is arranged such that a flow resistance that is lower, compared to a flow resistance of a central arrangement of said fixing lug, becomes established for an expired gas, said fixing lug having a Y-shaped cross section in a plane of said flexible valve membrane.

7. A breathing mask with a directional valve in accordance with claim 6, wherein said fixing lug is arranged offset relative to said center of the total area in a range between 8% and 25% relative to a dimension of the longitudinal axis of said valve membrane.

8. A breathing mask with a directional valve in accordance with claim 6, wherein:

said center point of said valve membrane is able to move away from said valve seat during flow through said opening during the expiration phase.

9. A breathing mask with a directional valve in accordance with claim 6, wherein said fixing lug has a plurality of fixing points, all of said fixing points being eccentrically arranged on said flexible valve membrane, all points of said flexible valve membrane not fixed by said fixing points being a movable portion;

said valve seat and said fixing lug are dimensioned to move all of said movable portion of said valve membrane away from said valve seat during flow through said opening during said expiration phase.

10. A breathing mask with a directional valve in accordance with claim 6, wherein said valve membrane has a circular design and the longitudinal axis is a diameter of said valve membrane.

11. A breathing mask with a directional valve, the breathing mask comprising:

a valve housing;

a flexible valve membrane having an eccentric fixed portion, all points in said eccentric fixed portion being eccentrically arranged on said flexible valve membrane, said flexible valve membrane defining a movable region, said movable position comprising a centroid of said flexible valve membrane;

a valve seat cooperating with said valve membrane and having a flat sealing surface, which surrounds an opening, said valve seat having a lateral edge, which extends upright from said sealing surface and receives said valve membrane; and a fixing lug arranged eccentrically relative to valve membrane and fastened to said valve housing, said fixing lug fixing said fixed portion relative to said valve seat, said fixing lug being dimensioned for fixing the valve membrane against said sealing surface of said valve seat, wherein a size of an eccentric offset of said fixed portion and said fixing lug are selected to be such that said valve membrane lifts off over an entire circumference of said sealing surface during an expiration phase, and such that all of said valve membrane around said eccentric fixed portion, which includes said movable region and said centroid, is able to move away from said valve seat during the expiration phase, said fixing lug having a Y-shaped cross section in a plane of said flexible valve membrane, said fixing lug being arranged on a side of said valve membrane diametrically opposite said valve seat.

12. A breathing mask with a directional valve in accordance with claim 11, wherein:

said fixed portion is fixed relative to said valve seat during flow in said one direction;

the eccentric offset is in a range between 8% and 15% of a length of a greatest longitudinal extension of said valve membrane.

13. A breathing mask with a directional valve in accordance with claim 11, wherein:

a center of said valve membrane is able to move away from said valve seat during flow through said opening during the expiration phase.

14. A breathing mask with a directional valve, the breathing mask comprising:

a valve seat having a sealing surface, said valve seat defining an opening;

a flexible valve membrane arranged on said valve seat, said flexible valve membrane having a circumference, a fixed portion and a center, said center including a center point of said flexible valve membrane;

a fixing lug eccentrically arranged on said valve membrane, said fixing lug fixing said fixed portion of said valve membrane relative to said valve seat, said fixing lug being dimensioned for fixing the valve membrane against said sealing surface of said valve seat during absence of flow through the directional valve, said valve seat and said fixing lug being dimensioned to move said circumference and said center point of said valve membrane away from said valve seat in one direction during flow through said opening in said one direction, wherein a size of an eccentric offset of said fixed portion is selected to be such that said valve membrane lifts off over an entire circumference of said sealing surface during flow in said one direction, said fixing lug having a plurality of fixing points to fix said valve membrane to said fixing lug, said fixing lug being arranged on a side of said valve membrane diametrically opposite said valve seat, said plurality of fixing points of said fixing lug being arranged in Y-shape in a plane parallel to said valve membrane.

15. A breathing mask with a directional valve in accordance with claim 14, wherein:

said fixed portion is arranged eccentrically relative to said valve membrane, all points in said fixed portion are eccentrically arranged on said flexible valve membrane;

said flexible valve membrane has a movable portion including all of said valve membrane between said circumference and said fixed portion, said movable portion including said center point, said center point being a centroid of said flexible valve membrane;

said valve seat and said fixing lug are dimensioned to move all of said movable portion of said valve membrane away from said valve seat during flow through said opening in said one direction.

16. A breathing mask with a directional valve in accordance with claim 14, wherein:

said fixed portion is fixed relative to said valve seat during flow in said one direction;

said fixing lug is arranged on a side of said membrane diametrically opposite said valve seat;

said plurality of fixing points arranging an arching of said valve membrane to bias said valve membrane in contact with said sealing surface, all of said fixing points are eccentrically arranged on said flexible valve membrane, all points of said flexible valve membrane not fixed by said fixing points being a movable portion;

said valve seat and said fixing lug are dimensioned to move all of said movable portion of said valve membrane away from said valve seat during flow through said opening in said one direction.

17. A breathing mask with a directional valve in accordance with claim 14, wherein:

said fixed portion is fixed relative to said valve seat during flow in said one direction;

said eccentric offset is in a range between 8% and 15% of a length of a greatest longitudinal extension of said valve membrane.

* * * * *